US008516614B2

(12) United States Patent
Karasina

(10) Patent No.: US 8,516,614 B2
(45) Date of Patent: Aug. 27, 2013

(54) SHIRT HAVING FORM-FITTING MID-SECTION SUPPORT

(76) Inventor: Svetlana Karasina, Basking Ridge, NJ (US)

( * ) Notice: Subject to any disclaimer, the term of this patent is extended or adjusted under 35 U.S.C. 154(b) by 588 days.

(21) Appl. No.: 12/798,549

(22) Filed: Apr. 6, 2010

(65) Prior Publication Data

US 2010/0192274 A1 Aug. 5, 2010

Related U.S. Application Data

(63) Continuation-in-part of application No. 11/638,293, filed on Dec. 12, 2006, now Pat. No. 8,087,094.

(51) Int. Cl.
*A41B 1/00* (2006.01)

(52) U.S. Cl.
USPC ..... 2/77; 2/115

(58) Field of Classification Search
USPC ..... 2/77, 104, 106, 107, 113, 114, 115, 2/117, 274, 69, 67; 602/61, 60, 75; 128/873, 128/874, 875; 450/30
See application file for complete search history.

(56) References Cited

U.S. PATENT DOCUMENTS

| | | | | |
|---|---|---|---|---|
| 432,442 | A | 7/1890 | Sanford | 2/113 |
| 1,380,605 | A | 6/1921 | Swantees | 2/115 |
| 2,352,128 | A * | 6/1944 | Shikles, Jr. | 2/77 |
| 2,398,258 | A * | 4/1946 | Seegal | 2/115 |
| 2,456,190 | A | 12/1948 | Heilbronner | 2/90 |
| 4,065,814 | A | 1/1978 | Fox | 2/79 |
| 4,781,651 | A * | 11/1988 | Ekins | 450/79 |
| 6,053,852 | A | 4/2000 | Wilkinson | 482/127 |
| 6,076,187 | A | 6/2000 | Wallerstein | 2/115 |
| 6,817,034 | B2 | 11/2004 | Smilovic | 2/73 |
| 6,836,903 | B1 | 1/2005 | Goldstein | 2/69 |
| 7,395,557 | B1 * | 7/2008 | Ledyard | 2/113 |
| 2003/0106130 | A1 | 6/2003 | Reynolds | 2/69 |
| 2005/0177920 | A1 | 8/2005 | Wilkinson | 2/69 |

FOREIGN PATENT DOCUMENTS

| | | |
|---|---|---|
| CH | 684380 | 9/1994 |
| WO | WO 94/05171 | 3/1994 |

* cited by examiner

*Primary Examiner* — Amber Anderson
(74) *Attorney, Agent, or Firm* — Ernest D. Buff; Ernest D. Buff & Assoc. LLC; Margaret A. La Croix, Esq.

(57) ABSTRACT

A shirt supports and shapes the mid-section of a wearer. Support and shape thereby provided minimizes the appearance of the waistline. The shirt includes a top-section and a mid-section having lateral regions constructed to engage with a waistline of the wearer when the shirt is worn. At least two lateral portions are integrated within the lateral regions of the mid-section. These lateral portions are appointed to minimize the appearance of the waistline to optimally provide an hour-glass shape. The lateral portions are preferably constructed having a substantially elongated oval shape, and are preferably composed of a substantially non-stretching material. These lateral portions provide support for the lateral abdominal wall of the abdominal region and back of the wearer where "love handles" and thick waists sometimes develop. Advantageously, the shirt may be worn as an undershirt or as outerwear to discretely minimize the wearer's waistline.

21 Claims, 4 Drawing Sheets

SHIRT HAVING FORM-FITTING MID-SECTION SUPPORT

CROSS-REFERENCE TO RELATED APPLICATIONS

This application is a continuation-in-part of U.S. patent application Ser. No. 11/638,293, filed Dec. 12, 2006 now U.S. Pat. No. 8,087,094, entitled "Shirt Having Form-Fitting Mid-Section Support", the disclosure of which is hereby incorporated by reference.

BACKGROUND OF THE INVENTION

1. Field of the Invention

The present invention relates to a shirt having a form-fitting mid-section; and more particularly, to a shirt adapted to support and shape the mid and lower torso or waist of a wearer by providing a midsection having lateral portions integrated therein that minimize the appearance of the mid and lower torso at the waist line.

2. Description of the Prior Art

Confidence is oftentimes affected by one's own perception of his or her physical body appearance. In today's fitness minded world one's physique plays an important role in the perception of his or her self-image. Various garments, both underwear and outerwear, have been provided in attempts to enhance a wearer's physical appearance and confidence. However, none of the garments heretofore disclosed and utilized provide the ability for a wearer to minimize his or her virtually entire mid-section area having a plurality of fabric densities that provide multifaceted support for the abdominal area, lower back, and torso sides. Moreover, none of the garments heretofore disclosed and utilized provide an anatomically contoured shirt having lateral portions integrated therein; and being adapted to optimally fit and contour the female waistline. No garment has been provided that can be worn as an outer shirt that includes anatomically contoured lateral portions discretely integrated therein to provide a precise clear line on the waist side of the wearer.

Some garments heretofore utilized are simply constructed to prevent disheveling of the garment and to present a neat, clean unwrinkled appearance. These garments do not provide significant support to the body of the wearer, and they do not provide a minimizing or cinching affect. For example, U.S. Pat. No. 432,442 to Sanford discloses an undershirt having a bust portion, contracted waist portion, and a skirt portion having a vertically ribbed band provided at the lower end thereof to prevent the lower end of the skirt from working up-ward around the hip and seat portions of the body. U.S. Pat. No. 1,380,605 to Swantees discloses a lock garment, such as shirts for women's or men's wear generally including a connecting portion consisting of a single band to form a snug waistline so that the garment does not creep or slip above or below the wearer's waistline. Foreign Patent Publication No. WO94/05171 to Kooistra discloses a garment which is worn in the trousers or in the skirt, provided at its under-portion with a hip-fitting piece of elastic material in order to prevent the slipping out of trousers or skirt so that the garment remains neat and does not bunch up or become disheveled looking.

These existing garments do not provide the ability to minimize the wearer's waist-line or back. Instead, these garments provide portions that prevent the garment from creeping upward on a person's torso. Additionally, the portions are not integrated within the interstitials of a garment that can be worn as outerwear by the wearer. Rather, these garments are typically appointed to be worn as undergarments, worn under an outer garment.

Other garments provide elastic features built-in within the garment so that the garment is form-fitting in nature, and thus yields a leaner appearance to the wearer's physique, as well as to prevent unwanted shifting of the garment during wear. Elasticized form fitting garments are utilized, typically involving shirts or the like, appointed with discrete elastic portions woven within different sections thereof. For example, U.S. Pat. No. 6,076,187 to Wallerstein discloses an elasticized form fitting shirt having an overall outward appearance of a standard shirt but provided with a plurality of elastic stretchable elements woven in the side portions, concentrated at the lower sides, i.e., at the waist sides, of the shirt, and are preferably woven into the basic shirting material in a graduated pattern so as to blend in with the basic shirt and thus be inconspicuous. U.S. Pat. No. 2,456,190 to Heilbronner discloses a self-adjusting shirt having a main section with pendant front and rear portions appointed with elastic-knitted material inserts having a v-shape construction extending vertically from the arm pits to the waist to give elasticity crosswise or about the body of the wearer so that the garment is fitted against the wearer's waist. U.S. Pat. No. 6,836,903 to Goldstein discloses a braided garment, shown as a shirt, wherein the shirt employs a braid located on both outer side surfaces to provide an attractive and decorative design and to provide expansion or contraction of the clothing, given the size and shape of the wearer. U.S. Patent Application Publication No. 2003/0106130 to Reynolds discloses body form-fitting rainwear having three-layers: an inner form-fitting fabric layer, a waterproof moisture vapor permeable hydrophobic layer, and an outer fabric layer.

Like the aforementioned garments appointed to prevent shifting upon the wearer's body, these elasticized form fitting garments generally provide elastic elements integrated into portions of the garment in order to shape and sculpt the garment, prevent bunching and creasing and provide a form-fitting appearance. Although the elastic elements are appointed to provide form-fitting of the garment onto the wearer's body, there is no indication that the elastic elements minimize the appearance of the wearer's torso and waist. Even still, the arrangement of the elasticized inserts or form-fitting fabric would not optimally facilitate rendering the appearance of a toned torso and waistline physique. Instead, it is likely that the wearer's waist line is not tightly minimized in a manner that mitigates spill-over of less toned areas of the wearer's torso. Instead, these types of garments will likely result in slight protrusion of the local un-sculpted area from the confines of the form-fitting fabric, producing discomfort and an unsightly bulgy appearance. Furthermore, these garments teach utilization of elastic elements integrated within portions of the garment. These elastic elements will tend to stretch and give as against the body, thereby decreasing the garment's ability to minimize the appearance of the wearer's torso and waist.

Still other support type garments provide toning body suits or the like that are adapted to render tension on the muscles of the wearer's body to facilitate toning of various muscle groups of the wearer. For example, U.S. Pat. No. 4,065,814 to Fox discloses a one piece elastic body suit appointed with an elastic waist and elongated elastic band members extending vertically over the length of the suit and over the shoulders and being attached to feet straps so that band members are placed under tension exerted by the feet of the wearer thereby exerting pressure on the muscles of the body. U.S. Pat. No. 6,053,852 to Wilkinson discloses a body suit having a shirt portion and pants portion joined together by an elastic abdominal ring that applies a longitudinal resistance force in response to movement of the body. Foreign Patent Publication No. CH684380 to Pejic et al. discloses an orthopedic T-shirt having an elastic band that is fitted on the inside in the shoulder region so that extension force of the elastic band indicates change in the correct positioning of the shoulder.

Body suits or garments such as these cannot be utilized as outerwear, nor can these body suits or garments be comfortably worn as an undergarment on a daily basis. Rather, these body suits and garments are appointed to be worn when a wearer desires to apply tension to his or her muscles in an attempt to tone their musculature as pressure is applied to the legs, back and shoulders, or when a wearer needs therapeutic treatment for his or her back. Extended wear of the body suit is not practical as wearing of the suit should typically only be done when the wearer intends to work their muscles. Elongated elastic bands are typically provided by these types of garments in order to cause resistance to the person's body in order to stimulate toning and strengthening of the body; the elongated bands or horizontal band of the orthopedic shirt do not function to minimize or cinch the torso of the wearer's body, and in fact may cause bulging thereof due to the arrangement of the elastic band or bands.

Support and shaping of a wearer's torso is intended by variously utilized garments. For example, maternity garments and garments for woman have been utilized to attempt to smooth and shape a woman's figure. These garments are designed for woman, and generally provide undergarments to be worn on the woman's torso, resembling a bodice type garment. See, U.S. Pat. No. 6,817,034 to Smilovic teaches a maternity undergarment that envelopes the woman's bust, torso, and thighs wherein the torso is elastically enwrapped by a torso section adapted to provide for the changing proportions of her abdomen by providing different stretch characteristics therein; shaping of the back, waist and around the buttocks is also provided. Although these maternity garments provide stretch fabric appointed to support and smooth the torso, the belly section is stretchable to accommodate the growing pregnant woman's belly. The actual lateral waistline of the wearer is not engaged with the support fabric, and though support is provided, the garment does not minimize the appearance of the body waistline, but merely supports same.

Likewise, a number of garments are provided that attempt to smooth and shape a wearer's waist by providing an elastic waistband appointed with a tensioning system, such as a belt or strap. For example, U.S. Patent Application Publication No. 2005/0177920 to Wilkinson discloses a garment for supporting and shaping the mid-section of a wearer by providing a wide elastic waistband extending from below the wearer's rib cage to the belly button, wherein the waistband is further appointed with an adjustable tensioning system, such as a strap or belt. The tensioning system required by these shape smoothing garments typically incorporate loops or rings and straps which can be adjustably manipulated in order to control the tension applied at the abdominal section. The elastic waistband and tensioning system disclosed by these shape smoothing garments cannot be readily worn inconspicuously as the tension system can be bulky to hide under another garment. In addition, the elastic waistband and tensioning system of these types of shape smoothing garments are located at the waist of the wearer extending there around, and as such minimize the circumference of the waist and a portion of the lower back at best, likely resulting in unsightly and uncomfortable bulging above and below the elastic waistband.

Notwithstanding the efforts of prior art workers to construct a support garment, there remains a need in the art for a shirt adapted to support and shape the mid-section of a wearer, and particularly sculpted to minimize the appearance of a waistline to yield an hourglass silhouette. There is a need in the art for a sculpting shirt which comprises a midsection having lateral portions constructed therein that minimize the appearance of the mid and lower torso at the waist line. In addition, there is a need in the art for a shirt wherein the lateral portions are constructed of substantially non-stretchable material and shaped substantially as ovals running laterally within the lateral midsection. Moreover, there is a need in the art for a shirt adapted to support and shape the mid-section or the waistline of a wearer, and which comprises a top-section having a simple, clean, substantially loose fitting and comfortable construction that affords breath-ability and comfort when worn.

SUMMARY OF THE INVENTION

The present invention provides a shirt adapted to support and shape the mid-section of a wearer. In particularly, the shirt is appointed for supporting and shaping the waistline of a wearer to minimize the waist and yield a more synched waistline. The shirt includes a top-section and a mid-section having lateral regions constructed to engage with a waistline of the wearer when the shirt is worn. At least two lateral portions are integrated within the lateral regions of the mid-section. These lateral portions are appointed to minimize the appearance of the waistline to optimally provide an hourglass shape. The lateral portions are preferably constructed having a substantially elongated oval shape and are preferably composed of a substantially non-stretching material. These lateral portions provide support for the lateral abdominal wall of the abdominal region and back of the wearer where "love handles" and thick waists sometimes develop. Advantageously, the shirt may be worn as an undershirt or as outerwear to discretely minimize the wearer's waistline. A feature of the invention also involves the directionality of the stitching for the cotton material used in the lateral portions of the Trim-T shirt. Preferably the stitching proceeds in a vertical direction (i.e. perpendicular to the belt of the wearer or bottom cuff of the shirt). When the directionality of the stitching is vertical, the cotton material of the lateral portions better resists stretching, and thus improves the holding or containment of love handles, etc. The stitching material may be a typical thread, but preferably the stitching material is a heavy duty thread such as a heavy fiber thread, Teflon coated thread, or silicon coated thread. The stitching may further be a very tight stitch with at least 10 stitches per cm of the material. The stitching orientation and stitch thread type are key factors that help to increase stretch resistance of the cotton material of the lateral portions.

In one embodiment the shirt includes a top-section and a mid-section having lateral regions constructed to engage with a waistline of the wearer when the shirt is worn. At least two lateral portions are integrated within the lateral regions of the mid-section. These lateral portions are appointed to minimize the appearance of the waistline to optimally provide an hourglass shape. The lateral portions are preferably constructed having a substantially elongated oval shape and are preferably composed of a substantially non-stretching material.

In another embodiment a shirt for supporting and shaping the mid-section of a wearer is provided that includes an outer portion. In this embodiment, the shirt includes a top-section and a mid-section having lateral regions, the lateral regions being constructed to engage with a waistline of the wearer when the shirt is worn. At least two lateral portions are integrated within the lateral regions of the mid-section appointed to minimize the appearance of the waistline. An outer portion is provided that extends over and covers the mid-section so that the mid-section is not visible, whereby the mid-section acts as an internal support structure when the shirt is worn as a T-shirt or outer garment.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

Figure 1:
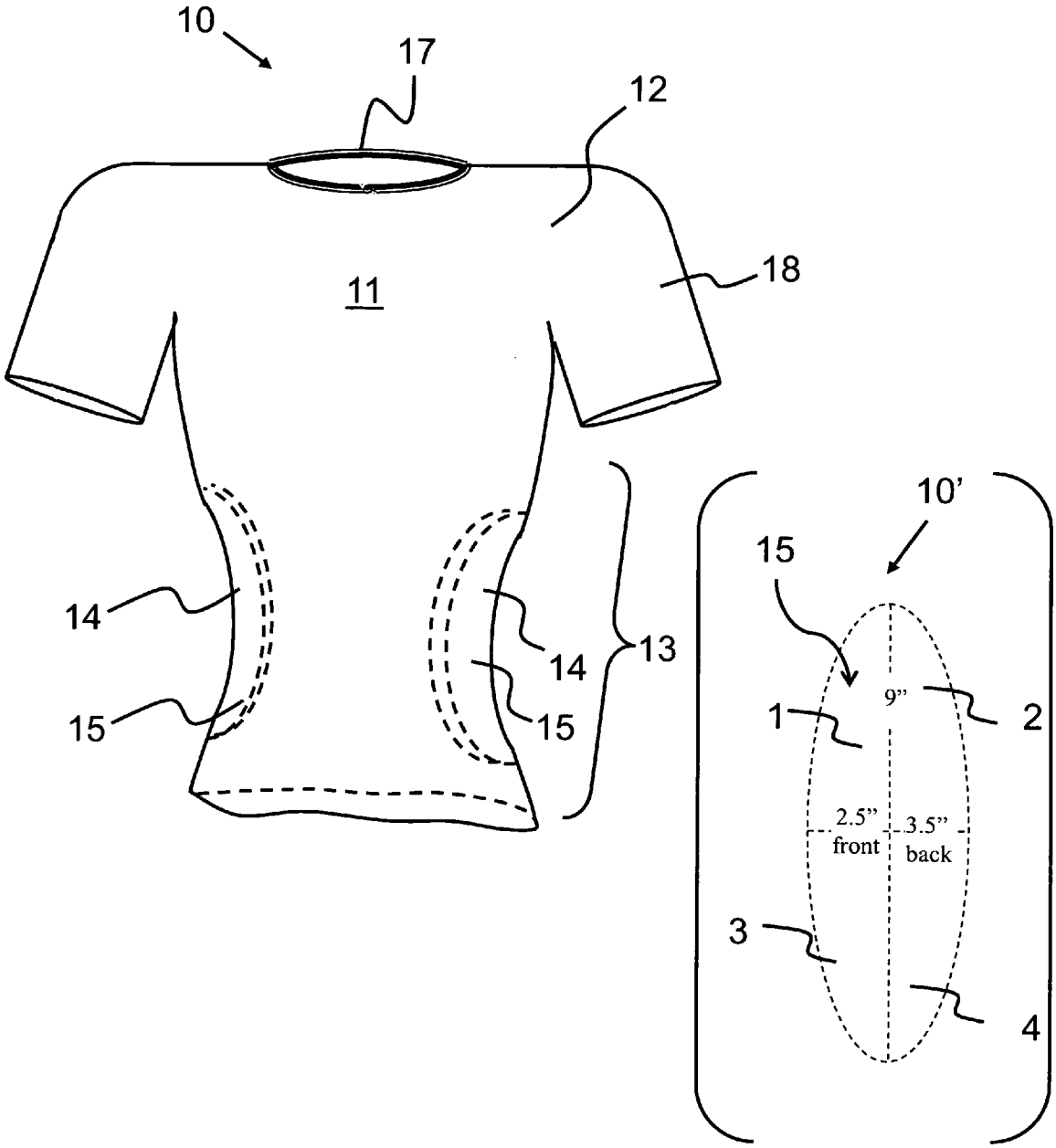
FIG. 1 illustrates a plane view of an embodiment of the shirt for supporting and shaping the mid-section of a wearer, particularly at the lateral abdominal wall region.

The present invention relates to a shirt for supporting and shaping the mid-section of a wearer. Support and shape provided to the waistline of a wearer minimizes the appearance of the waistline. Sculpting is generally achieved by way of lateral portions integrated within the mid-portion of the shirt that sculpt the lateral abdominal walls to synch the wearer's waistline. Different material densities or elasticity portions may be utilized throughout the construction of the shirt to render optimal minimization to the abdominal walls of the wearer. Preferably the shirt is substantially constructed of an elastic material, while the lateral portions are substantially constructed from a non-elastic or non-stretchable material. Owing to the non-stretchable nature of the lateral portions, as the lateral portions of the shirt press against the lateral abdominal walls of the wearer's body the lateral portions do not deform or expand and instead act to synch the lateral abdominal wall. Synching of the lateral abdominal wall yields a more streamlined, sculpted waistline for the wearer. The shirt has particular sculpting applications in sculpting a woman's waistline to accentuate an hourglass figure or small waistline. As a result, the abdominal region, including the lateral abdominal walls and abutting lower back and upper back regions where "love handles" accumulate are minimized so that the wearer's body projects a more toned appearance.

The shirt includes a top-section and a mid-section having lateral regions constructed to engage with a waistline of the wearer when the shirt is worn. At least two lateral portions are integrated within the lateral regions of the mid-section. These lateral portions are appointed to minimize the appearance of the waistline to optimally provide an hourglass shape. The lateral portions are preferably constructed having a substantially elongated oval shape and are preferably composed of a substantially non-stretching material. These lateral portions provide support for the lateral abdominal wall of the abdominal region and back of the wearer where "love handles" and thick waists sometimes develop. The lateral portions located within the lateral regions of the mid-portion of the shirt are preferably constructed having a substantially elongated oval shape. Advantageously, the shirt may be worn as an undershirt or as outerwear to discretely minimize the wearer's waistline. The top-section of the shirt for supporting and shaping the mid-section of a wearer has a substantially loose fitting construction that yields a simple, clean and comfortable fit, affording breath-ability and comfort.

The shirt minimizes certain problems associated with a person's mid-section area or waistline. Advantageously, the shirt provides the ability for a wearer to minimize his or her waistline area while at the same time providing a top-section that is loose and comfortable. The shirt for supporting and shaping the mid-section of a wearer is particularly well suited for use by women in yielding an hourglass silhouette; but can be gender neutral. In particular, the mid-section area of the shirt is adapted to minimize and support "problem" areas, such as the lateral abdominal walls and adjacent lower back, where "love handles" and "muffin tops" are prone to develop.

Figure 2:
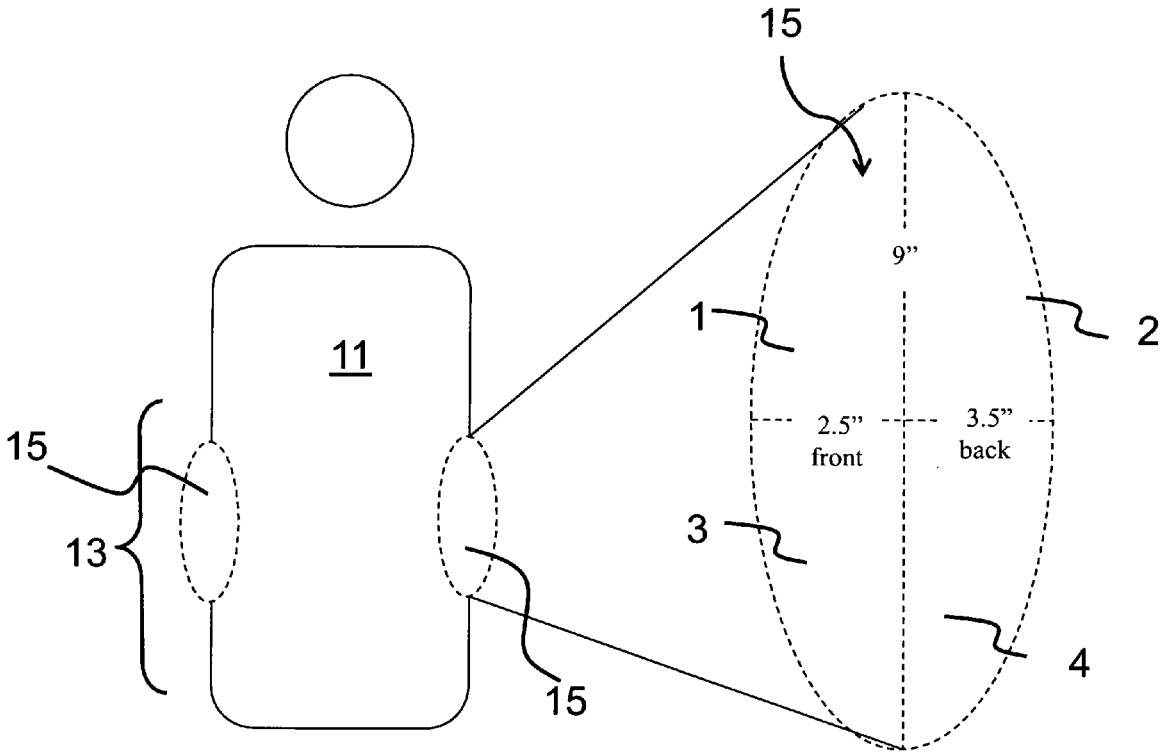
FIG. 2 depicts a schematic view of the embodiment shown generally in FIG. 1.

FIG. 1 illustrates generally at 10 a schematic view of an embodiment of the shirt for supporting and shaping the mid-section via lateral abdominal wall of a wearer. FIG. 2 depicts a schematic view of the embodiment shown generally in FIG. 1. The shirt for supporting and shaping the waistline of a wearer comprises a shirt 11 having a top-section 12, appointed with a collar 17 and sleeves 18, and a mid-section 13. Mid-section 13 includes lateral regions 14 constructed to engage with a waistline of the wearer when the shirt 11 is worn. At least two lateral portions 15 are integrated within the lateral regions of the mid-section. In this embodiment, the shirt 11 for supporting and shaping the mid-section of a wearer is preferably worn as an undergarment, but may be worn as a regular T-shirt (or as outerwear; See FIGS. 3 and 4). Preferably, mid-section 13 is preferably composed of an elastic material so that the mid-section 13 is form-fitting to a mid and lower torso of a person when shirt 11 is worn. Top section 12 can be composed of cotton or other non-stretchable fabric; but is preferably composed of an elastic material. As a result, the mid-section 13 and top-section 12 conform to the top, mid and lower torso of the wearer's body. The lateral abdominal wall or sides of the shirt are constructed with the integrated lateral portions 15 therein. Preferably, the lateral portions 15 are constructed of a non-elastic material so that the portions 15 do not stretch or deform and instead streamline the lateral abdominal walls of the wearer's waist. Alternatively, the lateral portions 15 are constructed of materials having a gradual varying degree of elasticity, such as a less elastic or substantially non-stretch material in quadrants 3 and 4, with a somewhat more elastic material in quadrants 1 and 2, for a gradual shaping effect. With this construction, the lateral portions 15 support and cinch the wearer's waist, minimizing its perceived size and enhancing the wearer's appearance.

These lateral portions 15 are appointed to minimize the appearance of the waistline to optimally provide an hourglass shape. The lateral portions are preferably constructed having a substantially elongated oval shape as shown at 10' and are preferably composed of a substantially non-stretching material. These lateral portions 15 provide support for the lateral abdominal wall of the abdominal region and back of the wearer where "love handles" and thick waists sometimes develop. Advantageously, the shirt may be worn as an undershirt or as outerwear to discretely minimize the wearer's waistline.

As the lateral portions 15 are preferably substantially composed of a non-stretchable material or material having substantially non-elastomeric components so that the lateral portions 15 press against the lateral abdominal walls of the wearer and push the waistline inward. The non-stretch material may be a woven cotton material, synthetic material such as that sold under the trade name Teflon, a denim material, non-stretch lace, rayon or chiffon material, or other substantially non-elastomeric materials. The lateral portions 15 are preferably inserted underneath the lateral regions 14 of the midsection 13 along the seam vertically located along lateral region 14. In such a situation, the lateral regions 14 may be composed of an elastic material that stretches over the more rigid substantially non-elastic lateral portion 15 or, alternatively. The lateral region 14 may be also composed of a substantially non-elastic material to further facilitate non-deformation or stretching of the lateral portions 15 and further facilitate in streamlining the sides of the waist or lateral abdominal walls.

Preferably the stitching proceeds in a vertical direction taken along X-X in FIGS. 1 and 2 (i.e. perpendicular to the belt of the wearer or bottom cuff of the shirt). When the directionality of the stitching is vertical, the cotton material of the lateral portions better resists stretching, and thus improves the holding or containment of love handles, etc. The stitching material may be a typical thread, but preferably the stitching material is a heavy duty thread such as a heavy fiber thread, Teflon coated thread, or silicon coated thread. The stitching may further be a very tight stitch with at least 10 stitches per cm of the material. The stitching orientation and stitch thread type are key factors which help increase stretch resistance of the cotton material of the lateral portions.

As best illustrated in FIG. 1 at 10' and FIG. 2, lateral portions are located adjacent to an arm-pit region of the shirt placed 1.5 inches to 2.0 inches below the arm-pit region, especially when the shirt is designed for use by a female. Alternatively, the lateral portions may be located adjacent to an arm-pit region of the shirt placed 2.0 inches to 2.5 inches below the arm-pit region, especially when the shirt is designed for a larger female or a male. The lateral portions 15 range in height from 6 inches to twelve inches. Preferably the lateral portions 15 range in height from 8 inches to ten inches. Most preferably the lateral portions 15 have a height of nine inches (9"). The lateral portions 15 range in width from 4 inches to ten inches. Most preferably lateral portions 15 are constructed having a front lateral segment which may further include mini segments 1, 3 and a rear lateral segment which may further include mini segments 2, 4. Preferably the front lateral segment 1, 3 has a slightly smaller radius from a centerline than the rear lateral segment 2, 4. Moreover, the lateral portions 15 may be made up of the plurality of portions 1, 2, 3, 4 each having varying degrees of elastic properties. The plurality of portions 1, 2, 3, 4 may each be composed of differing fibrous or elastic strength graduated in nature. The mid-section 13 has sufficient durability and strength to be operable to facilitate in minimizing the mid-section of the wearer. The lateral portions 15 may be composed of a cotton lining located on the interior of the shirt along lateral regions 14. Furthermore, the lateral portions 15 may be provided with an additional elastic tube or band or type of underwire running vertically along the lateral region 14.

Figure 3:
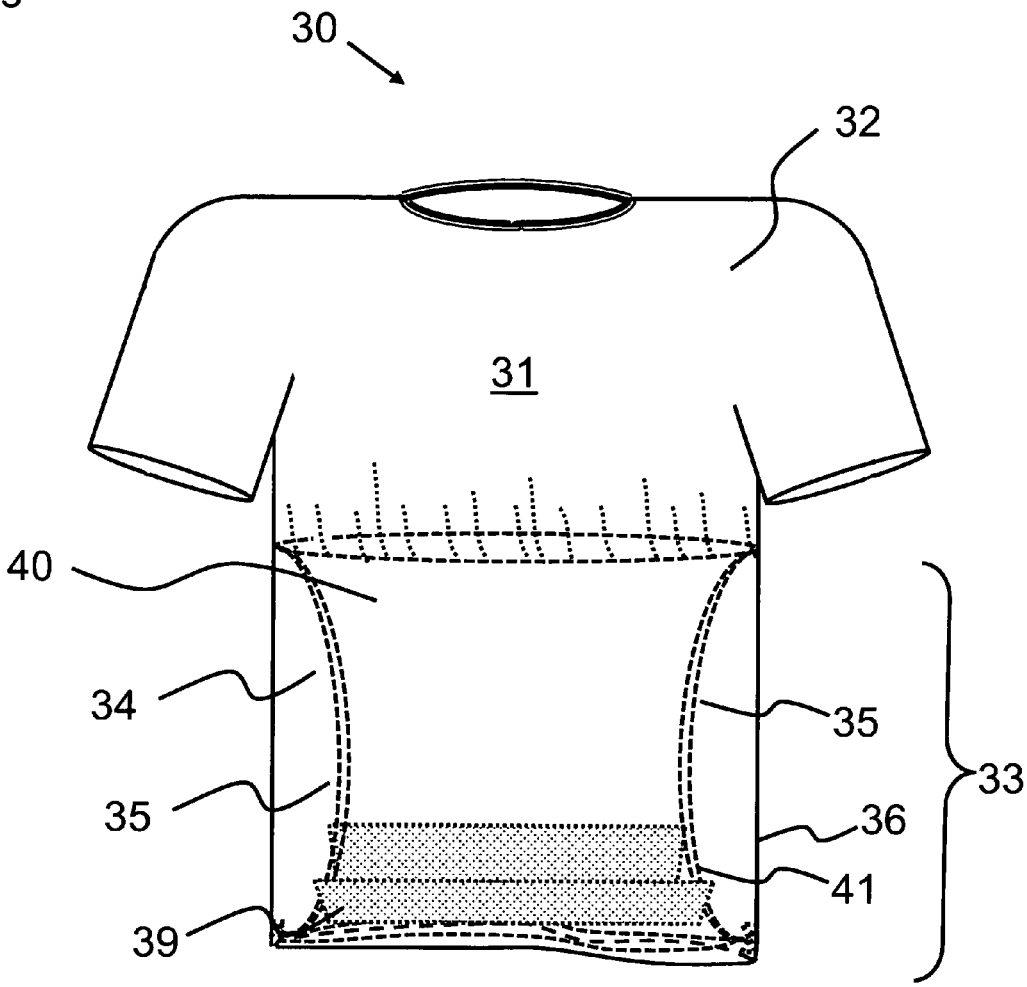
FIG. 3 illustrates a schematic view of another embodiment of the shirt for supporting and shaping the mid-section of a wearer, particularly at the lateral abdominal wall region.

FIG. 3 illustrates a schematic view of another embodiment of the shirt for supporting and shaping the mid-section of a wearer, particularly at the lateral abdominal wall region, shown generally at 30. The shirt 31 for supporting and shaping the mid-section of a wearer comprises a top-section 32 and a mid-section 33. In FIG. 3, mid-section 33 is under an outer portion 36 so that mid-section 33 is not visible to the public and thereby acts as an internal support structure when shirt 31 is worn as a T-shirt or outer wear. Mid-section 33 is composed of a material, preferably being an elastic material, so that mid-section 33 is form-fitting to a mid and lower torso of a person when shirt 31 is worn. The elasticized material composing mid-section 33 is durable and form-fitting so that the mid-section 33 conforms to the mid and lower torso of the person's body and supports and minimizes same in size and appearance.

Mid-section 33 includes lateral regions 34 constructed to engage with a waistline of the wearer when the shirt 31 is worn. At least two lateral portions 35 are integrated within the lateral regions of the mid-section. Preferably, mid-section 13 is preferably composed of an elastic material so that the mid-section 33 is form-fitting to a mid and lower torso of a person when shirt 31 is worn. Moreover, preferably top-section 32 is also composed of an elastic material. As a result, the mid-section 33 and top-section 32 conform to the top, mid and lower torso of the wearer's body; however the lateral abdominal wall or sides of the shirt are constructed with the integrated lateral portions 35 therein. Preferably, the lateral portions 35 are constructed of a non-elastic material so that the portions 35 do not stretch or deform and instead streamline the lateral abdominal walls of the wearer's waist. In doing so, the lateral portions 35 support and cinch the wearer's waist, minimizing its perceived size and enhancing the wearer's appearance.

Enhanced elasticity of the mid-portion 33 can further be facilitated by providing an additional lining 39 formed to encircle the waist and abdomen of the wearer as a tube effect. Lower region 39 is composed of at least one lower elasticity portion. This at least one lower elasticity portion of lower region 39 is preferably composed of a fibrous material having elastic properties. Lower region 39 may be composed of a plurality of lower elasticity portions so that the lower region 39 has a graduated nature; that is to say, that the lower elasticity portions may be of the same elastic nature, or they may vary gradually, increasing in elastic strength or increasing in fibrous density to form a gradual increase in strength as lower region 39 extends downwardly. In this manner, lower region 39 act to press in the abdomen in the front and the back area while the lateral portions 35 push in the lateral abdominal wall.

Mid-section 33 may further comprise an upper region 40 and a lower region 41. Upper region 40 is composed of at least one upper elasticity portion. The at least one upper and or lower elasticity portions of upper region 40 and lower region 41 are preferably composed of a fibrous material having elastic properties. Upper region 40 and/or lower region 41 may be composed of a plurality of upper or lower elasticity portions, respectively, so that the upper region 40 and/or lower region 41 have a graduated nature; that is to say, that the upper and or lower elasticity portions may be of the same elastic nature, or they may vary gradually, increasing in elastic strength or increasing in fibrous density to form a gradual increase in strength as the upper and lower regions 40 and 41 extend downwardly.

Lower region 41 is shown as a shaded region. Lower region 41 is composed of at least one lower elasticity portion. Lower elasticity portion of lower region 41 is composed of a fibrous material having substantially enhanced elastic properties. Lower region 41 is provided with increased elasticity via lower elasticity portion for enhanced minimization and support of the lower torso of a person wearing the shirt 31, thereby focusing in on the problem area associated with back sides of a wearer's torso, including "love handles". Preferably lower elasticity portion of lower region 41 is composed of a fibrous material having substantially enhanced elastic properties that provide greater support strength than the upper elasticity portion of upper region 40 of mid-section 33. Lower elasticity portion of lower region 41 may be composed of a cotton material or lining. Enhanced elasticity of the lower region 41 can further be facilitated by providing the sides of lower region 41 of mid-section 33 with lateral portions 39, preferably being composed of a cotton lining.

The top-section 32 and outer portion 36 of shirt 31 are composed of a high quality cotton material, which allows the body to breath and provides comfort to the wearer so that the wearer can move freely during daily activity without feeling constricted. Outer portion 36 hides mid-section 33 and visa vie lateral portions 35 so that the wearer can wear the shirt as a T-shirt or as outer wear with confidence.

Figure 4:
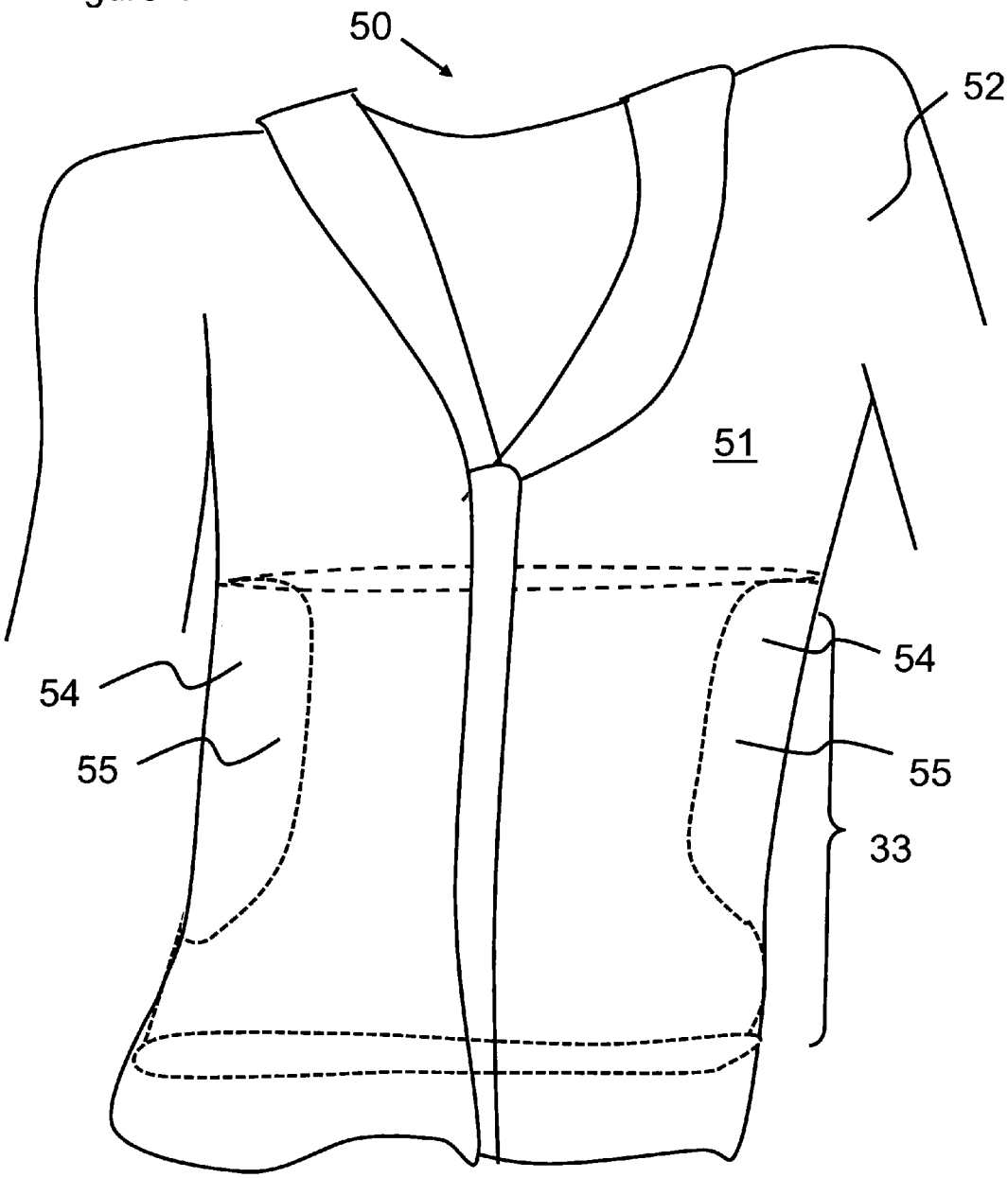
FIG. 4 illustrates a schematic view of another embodiment of the shirt for supporting and shaping the mid-section of a wearer as in FIG. 3, but shown as a blouse type shirt.

FIG. 4 illustrates a schematic view of another embodiment of the shirt for supporting and shaping the mid-section of a wearer as in FIG. 3, but shown as a blouse type shirt, shown generally at 50. The shirt 51 is shown as a blouse and includes a top-section 52 and a mid-section 53. In FIG. 4, like in FIG. 3, mid-section 53 is under an outer portion 56 so that mid-section 53 is not visible to the public and thereby acts as an internal support structure when shirt 51 is worn as a blouse. Mid-section 53 is composed of a material, preferably being an elastic material, so that mid-section 53 is form-fitting to a mid and lower torso of a person when shirt 51 is worn. Mid-section 53 includes lateral regions 54 constructed to engage with a waistline of the wearer when the shirt 51 is worn. At least two lateral portions 55 are integrated within the lateral regions of the mid-section. Preferably, the lateral portions 55 are constructed of a non-elastic material so that the portions 55 do not stretch or deform and instead streamline the lateral abdominal walls of the wearer's waist. In doing so, the lateral portions 55 support and cinch the wearer's waist, minimizing its perceived size and enhancing the wearer's appearance.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A shirt for supporting and shaping the mid-section of a wearer, comprising:

a. a top-section;

b. a mid-section having lateral regions, said lateral regions being constructed to engage with a waistline of said wearer when said shirt is worn;

c. at least two lateral portions integrated within said lateral regions of said mid-section appointed to minimize appearance of said waistline;

d. said lateral portions being substantially composed of a non-stretchable material; and e) wherein said lateral portions are composed of a cotton lining.

2. A shirt for supporting and shaping the mid-section of a wearer as recited by claim 1, wherein said lateral portions located within said lateral regions are constructed having a substantially elongated oval shape.

3. A shirt for supporting and shaping the mid-section of a wearer as recited by claim 1, wherein said top-section and said mid-section of said shirt are substantially composed of a stretchable material.

4. A shirt for supporting and shaping the mid-section of a wearer as recited by claim 1, wherein said lateral portions are located adjacent to an arm-pit region of said shirt placed 1.5 inches to 2.0 inches below said arm-pit region.

5. A shirt for supporting shaping the mid-section of a wearer as recited by claim 1, wherein said lateral portions are located adjacent to an arm-pit region of said shirt placed 2.0 inches to 2.5 inches below said arm-pit region.

6. A shirt for supporting and shaping the mid-section of a wearer as recited by claim 1, wherein said lateral portions range in height from 6 inches to twelve inches.

7. A shirt for supporting and shaping the mid-section of a wearer as recited by claim 1, wherein said lateral portions range in height from 8 inches to ten inches.

8. A shirt for supporting and shaping the mid-section of a wearer as recited by claim 1, wherein said lateral portions range in width from 4 inches to ten inches.

9. A shirt for supporting and shaping the mid-section of a wearer as recited by claim 1, wherein said lateral portions are constructed having a front lateral segment and a rear lateral segment.

10. A shirt for supporting and shaping the mid-section of a wearer as recited by claim 9, wherein said front lateral segment has a slightly smaller radius from a centerline than said rear lateral segment.

11. A shirt for supporting and shaping the mid-section of a wearer as recited by claim 1, wherein said mid-section has sufficient durability and strength to be operable to facilitate in minimizing said mid-section of said wearer.

12. A shirt for supporting and shaping the mid-section of a wearer as recited by claim 1, wherein said lateral portions are provided with an additional elastic tube or band.

13. A shirt for supporting and shaping the mid-section of a wearer, comprising:

a. a top-section;

b. a mid-section having lateral regions, said lateral regions being constructed to engage with a waistline of said wearer when said shirt is worn;

c. at least two lateral portions integrated within said lateral regions of said mid-section appointed to minimize appearance of said waistline; and d. an outer portion that extends over and covers said mid-section so that said mid-section is not visible, whereby said mid-section acts as an internal support structure when said shirt is worn as a T-shirt or outer garment; and e) said lateral portions being substantially composed of a non-stretchable material; and f) wherein said lateral portions are composed of a cotton lining.

14. A shirt for supporting and shaping the mid-section of a wearer as recited by claim 13, wherein said lateral portions located within said lateral regions are constructed having a substantially elongated oval shape.

15. A shirt for supporting and shaping the mid-section of a wearer as recited by claim 13, wherein said top-section and said mid-section of said shirt are substantially composed of a stretchable material.

16. A shirt for supporting and shaping the mid-section of a wearer as recited by claim 13, wherein said lateral portions are located adjacent to an arm-pit region of said shirt placed 1.5 inches to 2.0 inches below said arm-pit region.

17. A shirt for supporting and shaping the mid-section of a wearer as recited by claim 13, wherein said lateral portions are located adjacent to an arm-pit region of said shirt placed 2.0 inches to 2.5 inches below said arm-pit region.

18. A shirt for supporting and shaping the mid-section of a wearer as recited by claim 13, wherein said lateral portions are constructed having a front lateral segment and a rear lateral segment.

19. A shirt for supporting and shaping the mid-section of a wearer as recited by claim 18, wherein said front lateral segment has a slightly smaller radius from a centerline than said rear lateral segment.

20. A shirt for supporting and shaping the mid-section of a wearer, comprising:

a. a top-section;

b. a mid-section having lateral regions, said lateral regions being constructed to engage with a waistline of said wearer when said shirt is worn;

c. at least two lateral portions integrated within said lateral regions of said mid-section appointed to minimize appearance of said waistline; and d. said lateral portions being composed of a substantially non-stretchable cotton inserted underneath said lateral regions of said midsection, wherein said lateral regions and said midsection are composed of a stretchable material and said lateral portion are inserted along a seam.

21. A shirt for supporting and shaping the mid-section of a wearer as recited by claim 20, wherein said top-section and said mid-section of said shirt are substantially composed of a stretchable material.

* * * * *